US005802426A

United States Patent [19]

Miyazaki et al.

[11] Patent Number: 5,802,426

[45] Date of Patent: Sep. 1, 1998

[54] UNIT POSITIONING MEMBER FOR AN IMAGE FORMING APPARATUS

[75] Inventors: Masahiko Miyazaki; Naoyuki Ishida; Junichi Inada; Tadahiro Kiyosumi; Tetsuya Ichigotani, all of Osaka, Japan

[73] Assignee: Mita Industrial Co., Ltd., Osaka, Japan

[21] Appl. No.: 864,512

[22] Filed: May 28, 1997

[30] Foreign Application Priority Data

May 31, 1996 [JP] Japan ..... 8-138660

[51] Int. Cl.[6] ..... G03G 21/16

[52] U.S. Cl. ..... 399/113; 399/121; 399/122; 399/124

[58] Field of Search ..... 399/113, 121, 399/122, 124, 320, 110

[56] References Cited

U.S. PATENT DOCUMENTS 4,384,781 5/1983 Takada ..... 399/122

4,421,401 12/1983 Kagiura et al. ..... 399/122

5,300,998 4/1994 Ogisawa et al. ..... 399/124

*Primary Examiner*—Nestor Ramirez

*Attorney, Agent, or Firm*—Beveridge, DeGrandi, Weilacher & Young, LLP

[57] ABSTRACT

An image forming apparatus according to the present invention comprises three units, that is, an image forming unit 40, a fixing unit 60, and a transfer unit 50. The three units are mounted on a main frame 10 with a positional relationship upon being positioned therebetween. The image forming unit 40 is fixed to a predetermined position with respect to the main frame 10. Further, the main frame 10 comprises a positioning pin 14 arranged in a predetermined positional relationship with the image forming unit 40. The fixing unit 60 and the transfer unit 50 are positioned upon being engaged with the positioning pin 14. Consequently, there is no shift in position among the image forming unit 40, the transfer unit 50, and the fixing unit 60. The three units can be correctly mounted on the main frame 10.

10 Claims, 4 Drawing Sheets

UNIT POSITIONING MEMBER FOR AN IMAGE FORMING APPARATUS

This application is based on an application No. 8-138660 filed in Japan, the content of which is incorporated hereinto by reference.

BACKGROUND OF THE INVENTION

1. Field of the Invention

The present invention relates to an image forming apparatus such as an electrostatic process copying machine.

2. Description of the Prior Art

Conventionally, an image forming apparatus has been adapted to develop an electrostatic latent image formed on a photosensitive drum into a toner image, transfer the toner image to a paper sheet from the photosensitive drum, convey the paper sheet having the image transferred thereto to a fixing unit by a conveying section, and fix the image to the paper sheet by a fixing roller provided in the fixing unit.

The respective sections such as the fixing unit, the conveying section, and the photosensitive drum are accurately put in predetermined positions of the main body of the apparatus and are respectively mounted thereon. Therefore, correct alignment is required at the time of assembling. When some sections are so mounted as to be displaceable from the necessity of jam processing or the like, the main body of the apparatus is provided with positioning members accurately positioned for the respective sections, and each sections is mounted on the basis of the positioning members.

Since the positioning member is provided for each section, however, the number of parts tends to be increased. Further, positioning among the positioning members must be accurately obtained.

When the respective sections are not accurately positioned, for example, when positioning between the conveying section and the fixing unit is not accurate, the paper sheet conveyed by the conveying section is not accurately conveyed to the fixing roller in the fixing unit. As a result, the image on the paper sheet may, in some cases, be distorted before the fixing. Further, the paper sheet may, in some cases, be wrinkled or slanted.

SUMMARY OF THE INVENTION

Therefore, an object of the present invention is to solve the above-mentioned technical problems and to provide an image forming apparatus in which positioning between a conveying section and a fixing unit is obtained with high precision by a smaller numbers of parts.

In order to attain the above-mentioned object, an image forming apparatus according to the present invention is characterized by comprising a reference positioning member provided in a predetermined position with respect to the position where the image forming unit is arranged, an abutting member provided in a predetermined position of the fixing unit, and an engaging member provided in a predetermined position of the conveying unit, the abutting member in the fixing unit abutting on the reference positioning member, and the engaging member in the conveying unit being engaged with the reference positioning member, so that positioning among the image forming unit, the fixing unit and the conveying unit is obtained.

According to the construction, the fixing unit and the conveying unit are positioned with high precision with respect to the image forming unit by the same reference positioning member. As a result, the conveying unit can convey the paper sheet with high precision, whereby the paper sheet is not easily wrinkled, slanted and jammed, and an image formed thereon is not easily distorted, for example.

The foregoing and other objects, features, aspects and advantages of the present invention will become more apparent from the following detailed description of the present invention when taken in conjunction with the accompanying drawings.

PREFERRED EMBODIMENT OF THE PRESENT INVENTION

Figure 1:
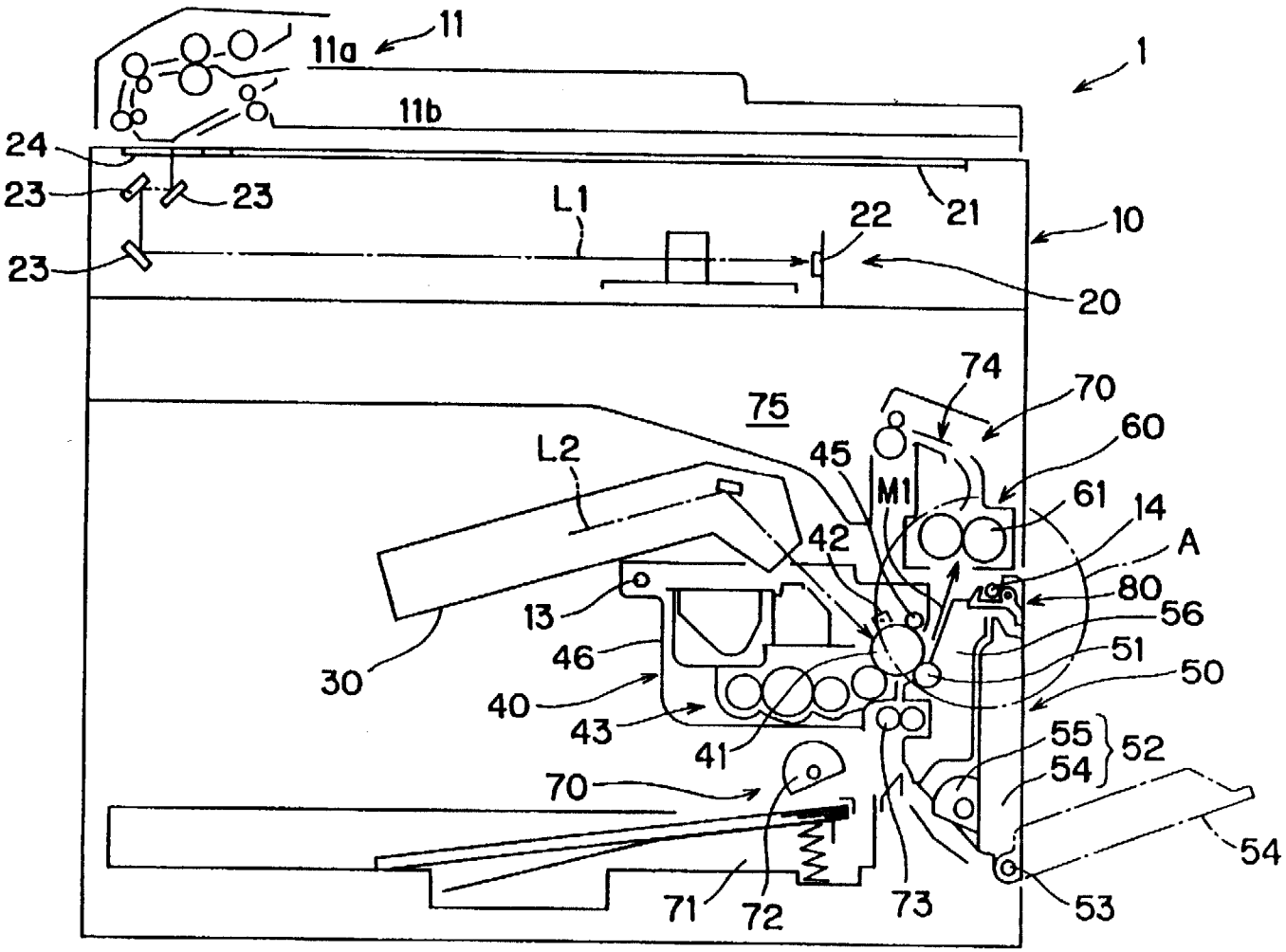
FIG. 1 is a front sectional view showing the schematic construction of a copying machine according to an embodiment of the present invention.

FIG. 1 is a schematic view showing the construction of an internal cross section of a multi-function copying machine according to one embodiment of the present invention.

Referring to FIG. 1, a copying machine 1 can function not only as a copying machine but also as a facsimile upon being connected to an external communication line and as a printer or an image scanner upon being connected to a personal computer or the like (not shown). Description is now made of a case where the copying machine 1 functions as a copying machine.

The copying machine 1 comprises in an upper part of the main body of the apparatus 10, (a) an automatic document feeder 11 so mounted as to be rotatably opened and closed on the upper surface of a transparent platen 21, for automatically delivering originals put on a mounting section 11*a* of the upper surface one at a time and feeding the originals into a paper discharging section 11*b* through a transparent reading window 24, and (b) a reading section 20 including an optical system such as a mirror 23 for exposing the originals passing through the reading window 24 by the automatic document feeder 11 or exposing and scanning the originals put on the transparent platen 21 and introducing light reflected from the originals into a light receiving element 22, for converting the reflected light into an electric signal by the light receiving element 22.

The signal from the reading section 20 is subjected to predetermined processing by a signal processing section (not shown) provided inside the main body of the apparatus 10.

Furthermore, the copying machine 1 comprises in an inner part of the main body of the apparatus 10, (c) a light irradiating unit 30 for scanning laser light set into oscillation from a semiconductor laser or the like by a polygon mirror or the like in accordance with the signal from the signal processing section to obtain predetermined beam light, (d) an image forming unit 40 comprising a photosensitive drum 41 for forming a latent image corresponding to the light from the light irradiating unit 30 and a developing device 43 for developing the electrostatic latent image formed on the photosensitive drum 41 into a toner image, (e) a transfer unit 50 including a transfer roller 51 provided opposite to the photosensitive drum 41 for transferring to paper sheets the toner image obtained by the development on the photosensitive drum 41, for conveying the paper sheets in a predetermined direction of conveyance, (f) a fixing unit 60 for heating and fixing the toner image transferred to the paper sheets, and (g) a paper conveying unit 70 having a paper feeding section in the preceding stage for delivering a paper sheet from a paper feeding tray 71 and feeding the paper sheet into the image forming unit 40 and a paper discharging section in the succeeding stage for discharging the paper sheet delivered from the fixing unit 60 into a discharge space 75 opening in the center of the main body, a portion intermediate between the preceding and succeeding stages being shared between the fixing unit 60 and the transfer unit 50.

In order to obtain a good image, positioning is obtained with high precision among the respective units.

Figure 2:
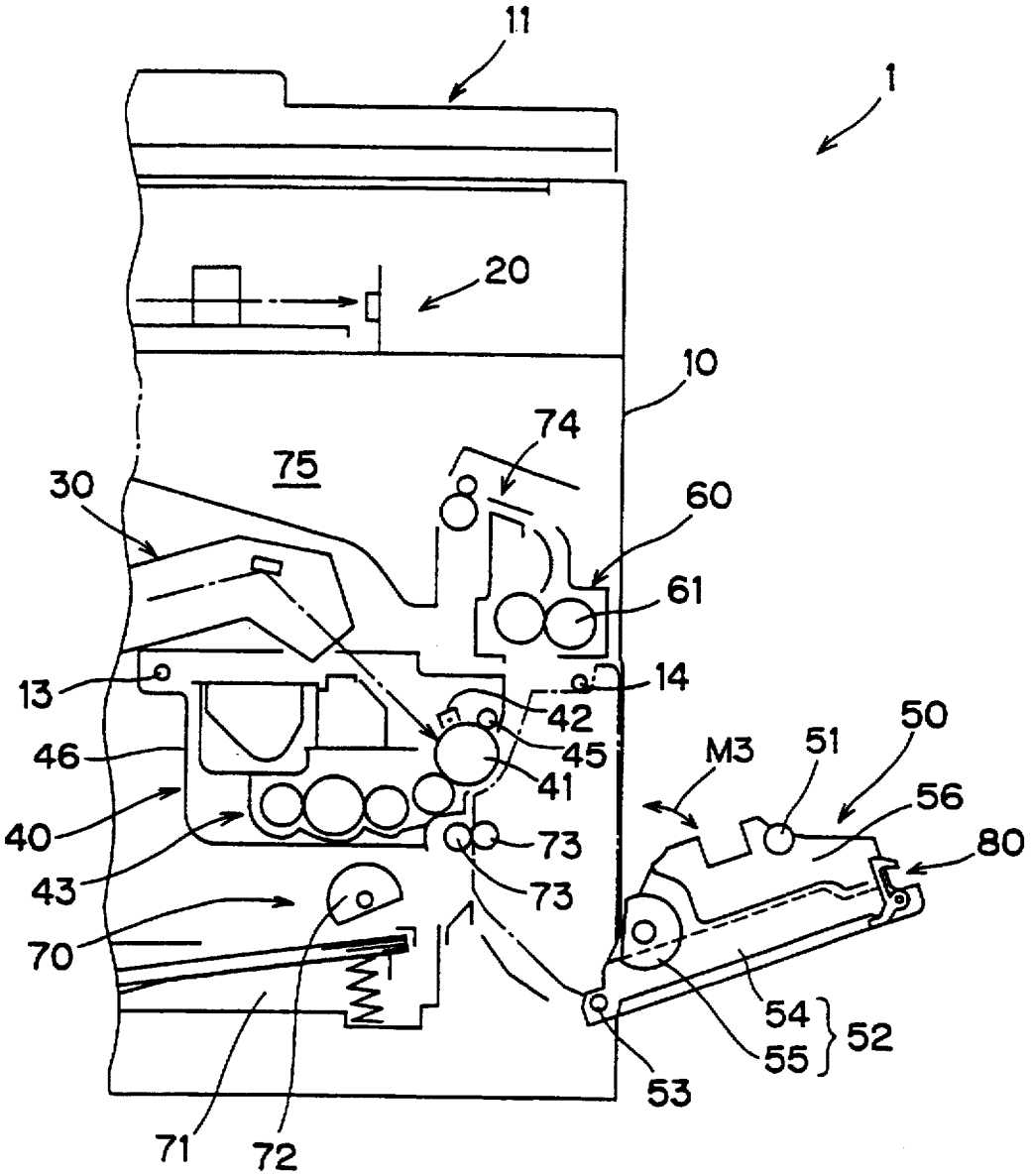
FIG. 2 is an enlarged view of a right side portion of the copying machine shown in FIG. 1, which illustrates a state where a transfer unit is opened.

FIG. 2 is an enlarged view of a right side portion of the copying machine 1 shown in FIG. 1, which illustrates a state where the transfer unit 50 is opened.

The main body of the apparatus 10 has a main frame 10 formed in a box shape by a steel plate or the like. The above-mentioned sections (c) to (g) are mounted in the main frame 10 upon being put in predetermined positions. Therefore, positioning members are mounted in the main frame 10. For example, a reference positioning member 14 for positioning two units, the transfer unit 50 and the fixing unit 60, is provided in a right side portion of the main frame 10.

The positioning member 14 comprises positioning pins formed in a cylindrical shape. The positioning pins 14 are provided in a rear side and a front side of the main frame 10 in a state where their axes horizontally extend in a longitudinal direction (in a direction perpendicular to the surface of paper), so that they are paired with each other. The pair of positioning pins 14 is fixed upon being positioned in the vicinity of the boundary between the transfer unit 50 and the fixing unit 60.

Furthermore, another poisoning member 13 is provided in the center of the main frame 10, and the image forming unit 40 is positioned by the positioning member 13.

The entire image forming unit 40 is attachable and detachable to and from the main frame 10, and is positioned with respect to the main frame 10 using the positioning member 13.

In the image forming unit 40, a charging corona discharger 42, a developing device 43, and a cleaning device 45 are arranged in this order around the photosensitive drum 41. In the image forming unit 40, beam light from a light irradiating unit 30 is irradiated onto an outer peripheral surface of the photosensitive drum 41 uniformly charged by the charging corona discharger 42 to form a desired image thereon to form an electrostatic latent image, after which the electrostatic latent image is developed into a toner image by the developing device 43. The toner image obtained by the development is transferred on paper sheets passing between the photosensitive drum 41 and the transfer roller 51. The remaining toner on the photosensitive drum 41 is recovered by the cleaning device 45.

The paper conveying section 70 comprises a paper feeding tray 71 containing paper sheets, a paper feeding roller 72 for feeding the paper sheet from the paper feeding tray 71 at a time, and a pair of registration rollers 73 for feeding the paper sheet fed from the paper feeding roller 72 into the photosensitive drum 41 at predetermined timing. In a portion from the registration rollers 73 to the fixing unit 60, a paper conveying path is formed by the image forming unit 40 and the transfer unit 50. A paper conveying path is also formed inside the fixing unit 60. Further, there are provided a discharged paper conveying path 74 including a pair of rollers, a guide plate, and the like for discharging the paper sheet on which the toner image is fixed by the fixing unit 60 into the discharge space 75.

The paper sheet is fed to the registration rollers 73 from the paper feeding tray 71 by the paper feeding roller 72. The paper sheet fed from the registration rollers 73 passes between the photosensitive drum 41 and the transfer roller 51, and is conveyed upward from below (see an arrow MI shown in FIG. 1), to enter the fixing unit 60. Thereafter, the paper sheet is discharged through the discharged paper conveying path 74.

Figure 3:
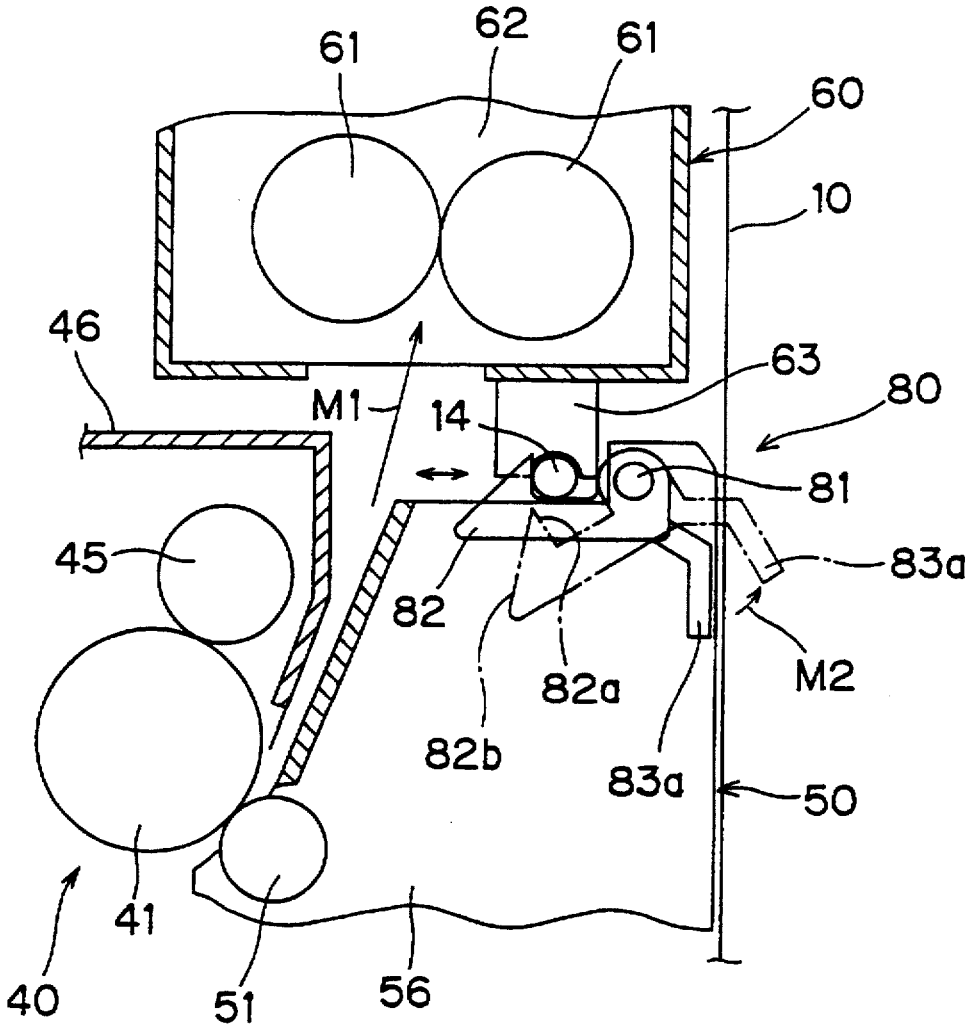
FIG. 3 is an enlarged front view of a portion A of the copying machine shown in FIG. 1.

FIG. 3 is an enlarged front view of a portion A of the copying machine shown in FIG. 1.

The fixing unit 60 comprises a pair of fixing rollers 61 arranged opposite to each other, a frame 62 for rotatably supporting the fixing rollers 61, and a pair of abutting members 63 fastened to the frame 62. The abutting members 63 are provided in a rear side and a front side of the frame 62 in a state where their shapes are overlapped in FIG. 3. The each abutting member 63 is fitted to the positioning members 14, so that the fixing unit 60 is positioned. In this state, the frame 62 is fixed to the main frame 10 by tightening a screw, for example.

A semicircular recess opening downward is formed in each abutting member 63. The inner diameter of the recess is approximately the same as the outer diameter of the positioning pin 14. The fixing unit 60 is arranged in order that the abutting members 63 are positioned on the positioning pins 14. Consequently, an inner peripheral surface of the recess formed in the each abutting members 63 and an outer peripheral surface of the positioning pins 14 abut on each other, so that the fixing unit 60 and the main frame 10 are positioned in the vertical and horizontal directions in predetermined positions. The positioning pins 14 also positions the transfer unit 50 as described below, whereby the fixing unit 60 is also positioned with respect to the transfer unit 50.

The transfer unit 50 has a transfer roller 51, a frame 56 including a pair of side plates for rotatably supporting the transfer roller 51, a locking mechanism 80 engaged with the reference positioning member 14 provided at an upper end of the frame 56, a supporting shaft 53 for rotatably supporting a lower end of the frame 56 on the main frame 10, and a manual paper feeding section 52 connected to the lower end of the frame 56 for manually feeding the paper sheet, as shown in FIG. 1.

Figure 4:
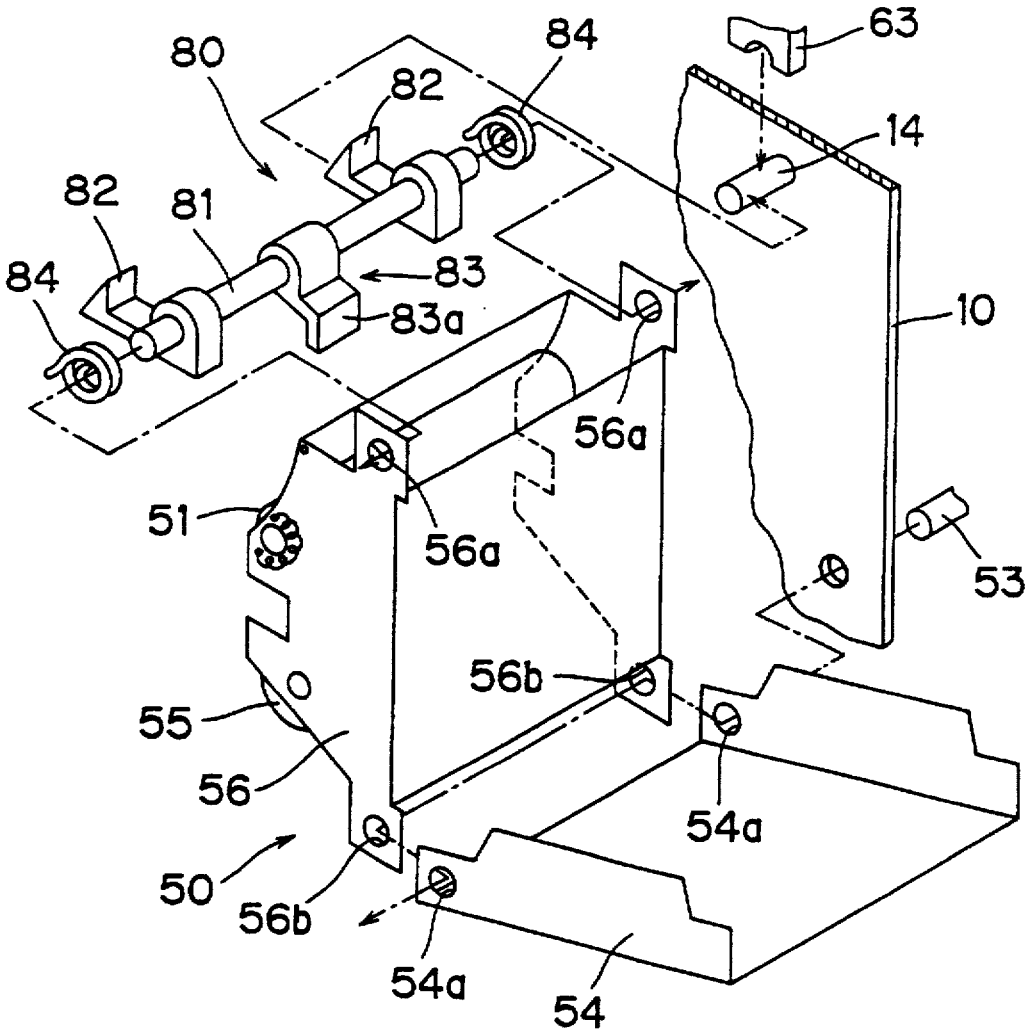
FIG. 4 is an exploded perspective view of a transfer unit in the copying machine shown in FIG. 1 and its peripheral portion.

FIG. 4 is an exploded perspective view of the transfer unit 50 and its peripheral portion.

The transfer roller 51 is arranged parallel to the photosensitive drum 41 so that their peripheral surfaces are brought into contact with each other. Therefore, the transfer roller 51 is urged with both its ends directed toward the photosensitive drum 41 (toward the upper left in FIG. 1) by a spring mounted on the frame 56.

The frame 56 has a pair of fitting holes **56*a* on which the locking mechanism 80 is mounted at its upper end and a pair of fitting holes 56*b* through which the supporting shaft 53** is inserted at its lower end.

The supporting shaft 53 is horizontally fixed to the main frame 10 upon extending in a longitudinal direction. The supporting shaft 53 is inserted through the fitting holes 56b of the frame 56 and a pair of fitting holes 54a of a paper feeding tray 54 as described later, to rotatably support the frame 56 and the paper feeding tray 54, respectively.

The transfer unit 50 is mounted on the main frame 10 so as to be rotatable around the supporting shaft 53 in a state where the above-mentioned sections are formed as a unit. The transfer unit 50 can be moved to a closed state where it vertically stands (the state shown FIG. 1) and an opened state where it obliquely falls (the state shown in FIG. 2) by being rotated. In the mounted state, the locking mechanism 80 and the reference positioning member 14 are in an engaged state, whereby the transfer unit 50 can convey paper sheet, and paper sheet can be fed from the manual paper feeding section 52.

The manual paper feeding section 52 comprises a paper feeding tray 54 on which paper sheets can be put, and a paper feeding roller 55 for feeding the paper sheet in the paper feeding tray 54 at a time. The paper feeding roller 55 is mounted on the frame 56, and the paper feeding tray 54 is mounted on the frame 56 so as to be rotatably opened and closed around the supporting shaft 53. The paper feeding tray 54 is opened at the time of manual paper feeding. That is, an upper part of the paper feeding tray 54 is projected from a right side surface of the main body of the apparatus 10 around 10 the supporting shaft 53 (indicated by a one dot and dash line in FIG. 1). Further, the paper feeding tray 54 can be closed so as to be flush with a side surface of the main body 10.

Referring to FIGS. 3 and 4, the locking mechanism 80 comprises a supporting shaft 81 rotatably supported on the fitting holes 56a of the frame 56, a pair of hook-shaped engaging members 82 fixed to the supporting shaft 81, a handle 83 fixed to the center of the supporting shaft 81, and a pair of elastic members 84 composed of a helical spring for urging the supporting shaft 81 in a clockwise direction.

In the handle 83, an operating section 83a capable of exerting an operating force for rotating the supporting shaft 81 is formed.

A recess opening upward is formed in the center of each engaging member 82. When each positioning pin 14 enters the recess as described later, an abutting surface 82a which is a side surface of the recess abuts on the outer peripheral surface of the positioning pin 14, respectively, and the pair of engaging members 82 and the positioning pins 14 are positioned each other.

The pair of elastic members 84 urges the supporting shaft 81 in a clockwise direction in order that the pair of engaging members 82 is maintained in its engaged position (a state indicated by a solid line in FIG. 3). The pair of elastic members 84 is not limited to a helical spring, provided that it can urge the engaging members 82 into an engaged state. It may be one indirectly urging the engaging members 82.

Operations will be described with reference to FIG. 3. The transfer unit 50 is positioned in the closed state as will be described. That is, the frame 56 receives reaction (rightward) in a case where the transfer roller 51 is urged toward the photosensitive drum 41 in its central portion, and is supported rotatably around the supporting shaft 53 at its lower end. As a result, each abutting surface 82a of each engaging member 82 at the upper end of the frame 56 abuts on the outer peripheral surface of the positioning pins 14, and is laterally positioned. In the transfer unit 50, the lower end of the frame 56 is positioned in the main frame 10 by the supporting shaft 53.

On the other hand, the operating section 83a of the handle 83 is lifted (rotated in a direction indicated by an arrow M2) against an elastic force of the elastic members 84, whereby the supporting shaft 81 is rotated. Correspondingly, a leading end of each engaging member 82 is lowered, so that an engaged state between each engaging member 82 and the positioning pins 14 is released. At the same time, the whole of the transfer unit 50 can be rotated around the supporting shaft 53 (an arrow M3 in FIG. 2), and is brought into the opened state.

In the opened state, jam processing or the like can be easily performed upon opening the paper conveying path formed between the transfer unit 50 and the image forming unit 40.

In a case where the transfer unit 50 is brought into the closed state, the transfer unit 50 is lifted upon being rotated around the supporting shaft 53. At this time, the pair of engaging members 82 is rotated around the supporting shaft 81 while an each inclined surface 82b at its leading end is along the outer peripheral surface of the positioning pins 14. When the transfer unit 50 is contained, the engaging members 82 is engaged with the positioning pins 14. It is thus possible to simultaneously achieve the positioning of the transfer unit 50 in the main body of the apparatus 10 and the fixing thereof.

According to the present embodiment, the fixing unit 60 and the transfer unit 50 are positioned with high precision in the main frame 10 by the same reference positioning member 14. Accordingly, the transfer unit 50 can convey paper sheets to the fixing unit 60 with high precision, so that the paper sheet is not easily wrinkled, slanted and jammed, and an image formed thereon is not easily distorted, for example.

Particularly if a paper conveying path leading to the fixing unit 60 from the transfer unit 50 has a slight step, the image is liable to be distorted because toner is in an unfixed state. Therefore, the fixing unit 60 and the transfer unit 50 are positioned in a direction intersecting the direction of conveyance, whereby a step does not easily occur. Therefore, the paper sheet can be conveyed with higher precision, and the image is not easily distorted.

Since the fixing unit 60 and the transfer unit 50 are positioned by one reference positioning member 14, the number of parts can be reduced, as compared with that in a case where they are respectively positioned by separate positioning members.

Furthermore, the transfer unit 50 is positioned by the pair of engaging members 82 with respect to the positioning member 14 and is held in the state, whereby the number of parts can be reduced, as compared with that in a case where positioning and holding are respectively achieved by separate members.

Although the positioning member 14 is positioned with respect to the main frame 10, the present invention is not limited to the same. As described above, the positioning member 14 is also positioned with respect to the image forming unit 40 positioned by the positioning member 13 provided in the main frame 10. In short, the positioning member 14 may be positioned with respect to a unit for image formation including the photosensitive drum 41.

Although the positioning member 14 is a pair of positioning pins, the present invention is not limited to the same. For example, it may be a portion integral with the main frame 10. Although the positioning member 14 is provided in the main frame 10, the present invention is not limited to the same. For example, the positioning member 14 may be provided in the fixing unit 60, and the abutting member 63 may be provided in the main frame 10. In short, the positioning member 14 may be a member interposed between the main frame 10 and the fixing unit 60 for obtaining positioning therebetween.

Although the elastic member 84 functions as engaged state holding means of the engaging member 82, such holding means need not be particularly provided. For example, if the engaging member 82 is stably supported in the engaged state, for example, the engaging member 82 is engaged from above the positioning member 14, the engaged state can be released only when the handle 83 is operated, whereby it is possible to omit the holding means.

In addition thereto, various design changes can be made in the range in which the gist of the present invention is not changed.

According to the present invention, the fixing unit and the conveying unit are positioned with high precision in the image forming unit by the same positioning member, whereby the paper sheets are not easily wrinkled, slanted, and jammed, and an image formed thereon is not easily distorted, for example. Further, the positioning member positions the fixing unit and the conveying unit, and holds the conveying unit, whereby it is possible to reduce the number of parts.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus having an image forming unit including a photosensitive drum, a fixing unit for fixing an image on a paper sheet, and a conveying unit for conveying the paper sheet from the image forming unit to the fixing unit, comprising:

a reference positioning member provided in a predetermined position with respect to the position where the image forming unit is arranged;

an abutting member provided in a predetermined position of the fixing unit; and an engaging member provided in a predetermined position of the conveying unit, the abutting member in the fixing unit abutting on the reference positioning member, and the engaging member in the conveying unit being engaged with the reference positioning member, so that positioning among the image forming unit, the fixing unit and the conveying unit is obtained.

2. The image forming apparatus according to claim 1, further comprising a main frame for constituting a main body of the apparatus, the reference positioning member being provided in the main frame.

3. The image forming apparatus according to claim 2, wherein the reference positioning member is a positioning pin in a cylindrical shape fixed to the main frame.

4. The image forming apparatus according to claim 3, wherein a semicircular recess engaged with the positioning pin is formed in the abutting member in the fixing unit.

5. The image forming apparatus according to claim 4, wherein the fixing unit is arranged upon being put on the positioning pin through the abutting member.

6. The image forming apparatus according to claim 5, wherein the conveying unit comprises a transfer unit having a conveying path in its part.

7. The image forming apparatus according to claim 6, wherein the transfer unit comprises a supporting shaft, is rotatable around the supporting shaft, and is displaceable between an opened state and a closed state where it is arranged in a predetermined position with respect to the image forming unit.

8. The image forming apparatus according to claim 7, wherein the transfer unit is rotatably held by said supporting shaft on the side of its lower end, and has a hook-shaped engaging member engaged with the positioning pin on the side of its upper end.

9. In an image forming apparatus having an image forming unit including a photosensitive drum, a fixing unit for fixing an image on a paper sheet, and a conveying unit for conveying the paper sheet from the image forming unit to the fixing unit, a method of positioning the image forming unit, the fixing unit and the conveying unit, comprising the steps of:

providing a reference positioning pin in a main frame of the image forming apparatus;

mounting the image forming unit on the main frame, to determine a positional relationship with the reference positioning pin to be a predetermined positional relationship;

mounting the fixing unit on the main frame so that the fixing unit abuts on the reference positioning pin; and engaging the conveying unit with the reference positioning pin, to mount the conveying unit on the main frame.

10. The positioning method according to claim 9, wherein the conveying unit comprises a transfer unit having a conveying path in its part.

* * * * *